US007513302B2

(12) United States Patent
Cassidy et al.

(10) Patent No.: US 7,513,302 B2
(45) Date of Patent: Apr. 7, 2009

(54) APPARATUS FOR ORIENTING A MULE SHOE TO ENTER A PREVIOUSLY-INSTALLED TUBULAR IN A LATERAL AND METHOD OF USE

(75) Inventors: Joseph H. Cassidy, Edmonton (CA); Vance E. Nixon, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/617,986

(22) Filed: Dec. 29, 2006

(65) Prior Publication Data

US 2008/0156479 A1 Jul. 3, 2008

(51) Int. Cl.
*E21B 7/06* (2006.01)

(52) U.S. Cl. ..... 166/117.6; 166/313; 166/381; 166/50

(58) Field of Classification Search ..... 166/313, 166/381, 50, 117.6
See application file for complete search history.

(56) References Cited

U.S. PATENT DOCUMENTS 2,333,802 A 11/1943 Lowrey
3,052,309 A * 9/1962 Eastman ..... 175/45
3,610,336 A * 10/1971 Sizer ..... 166/117.6
4,321,965 A 3/1982 Restarick et al.
5,318,121 A 6/1994 Brockman et al.
5,325,924 A 7/1994 Bangert et al.
5,832,998 A * 11/1998 Decker et al. ..... 166/185
6,012,527 A * 1/2000 Nitis et al. ..... 166/313
6,125,937 A * 10/2000 Longbottom et al. ..... 166/313
2004/0221997 A1* 11/2004 Giroux et al. ..... 166/380
2005/0006100 A1* 1/2005 Murray et al. ..... 166/313
2006/0207769 A1 9/2006 Corbett et al.
2007/0029084 A1* 2/2007 Tong et al. ..... 166/255.1

* cited by examiner

*Primary Examiner*—David J Bagnell
*Assistant Examiner*—Sean D Andrish
(74) *Attorney, Agent, or Firm*—James L. Kurka; Tim Curington

(57) ABSTRACT

A method of entering a previously-installed tubular in a lateral borehole from a primary borehole connected to the lateral borehole includes passing a downhole tool from the primary borehole into the lateral borehole, actuating an orientation mule shoe coupled to the downhole tool to lift the nose portion of the downhole tool into alignment with the tubular in the lateral borehole, and inserting the nose portion of the downhole tool into the tubular.

13 Claims, 2 Drawing Sheets

APPARATUS FOR ORIENTING A MULE SHOE TO ENTER A PREVIOUSLY-INSTALLED TUBULAR IN A LATERAL AND METHOD OF USE

BACKGROUND OF THE INVENTION

The invention relates generally to multilateral well operations. More particularly, the invention relates to a method and apparatus for accessing a branch of a multilateral well.

A multilateral well, also known as a multi-branch well, is a well having one or more lateral boreholes branching off a single primary wellbore. The primary wellbore may be vertical, horizontal, or deviated. The lateral boreholes may branch off the primary wellbore in any number of directions to allow production from several target reservoirs or formations through the primary wellbore. Multilateral wells are advantageous in comparison to single wells in that their lateral boreholes can be brought into close contact with several target reservoirs, thereby allowing production from the reservoirs to be maximized.

Tubulars are often installed in lateral boreholes. For example, in unconsolidated or weakly consolidated formations, liners are often installed in lateral boreholes to prevent the boreholes from collapsing. After such installation, it is often desirable to re-enter the tubular in order to perform one or more operations in the lateral borehole. Such re-entry operations generally include inserting a downhole tool into the tubular. In some cases, there may be eccentricity between the tubular and the lateral borehole, for example, due to formation washout. In this case, there is the likelihood that a downhole tool inserted into the lateral borehole would be misaligned with the tubular and may not be able to enter the tubular or may even become stuck in between the tubular and the lateral borehole.

From the foregoing, a method of assuring entry of a downhole tool into a tubular in a lateral borehole would be useful.

SUMMARY OF THE INVENTION

In one aspect, the invention relates to a method of entering a previously-installed tubular in a lateral borehole from a primary borehole connected to the lateral borehole. The method comprises passing a downhole tool from the primary borehole into the lateral borehole, actuating an orientation mule shoe coupled to the downhole tool to lift a nose portion of the downhole tool into alignment with the tubular in the lateral borehole, and inserting the nose portion of the downhole tool into the tubular. In one embodiment, actuating the orientation mule shoe comprises bringing a leading face of the orientation mule shoe in contact with an opposing face of the tubular. In one embodiment, actuating the orientation mule shoe comprises rotating the orientation mule shoe along a helical path.

In another aspect, the invention relates to a downhole tool for entering a previously-installed tubular in a lateral borehole of a multilateral well. The downhole tool comprises a downhole tool body sized for insertion into the tubular and an orientation mule shoe coupled to a nose portion of the downhole tool body and rotatable to lift the nose portion into alignment with the tubular. In one embodiment, the orientation mule shoe is inserted in a sleeve having an internal helical groove. In one embodiment, the orientation mule shoe includes a pin which slidably engages the helical groove. In one embodiment, a leading face of the orientation mule shoe includes a flat portion and a tapered or arcuate portion for achieving different positions of the orientation mule shoe with respect to the tubular.

Other features and advantages of the invention will be apparent from the following description and the appended claims.

BRIEF DESCRIPTION OF THE DRAWINGS

The accompanying drawings, described below, illustrate typical embodiments of the invention and are not to be considered limiting of the scope of the invention, for the invention may admit to other equally effective embodiments. The figures are not necessarily to scale, and certain features and certain view of the figures may be shown exaggerated in scale or in schematic in the interest of clarity and conciseness.

DETAILED DESCRIPTION OF THE INVENTION

Figure 1:
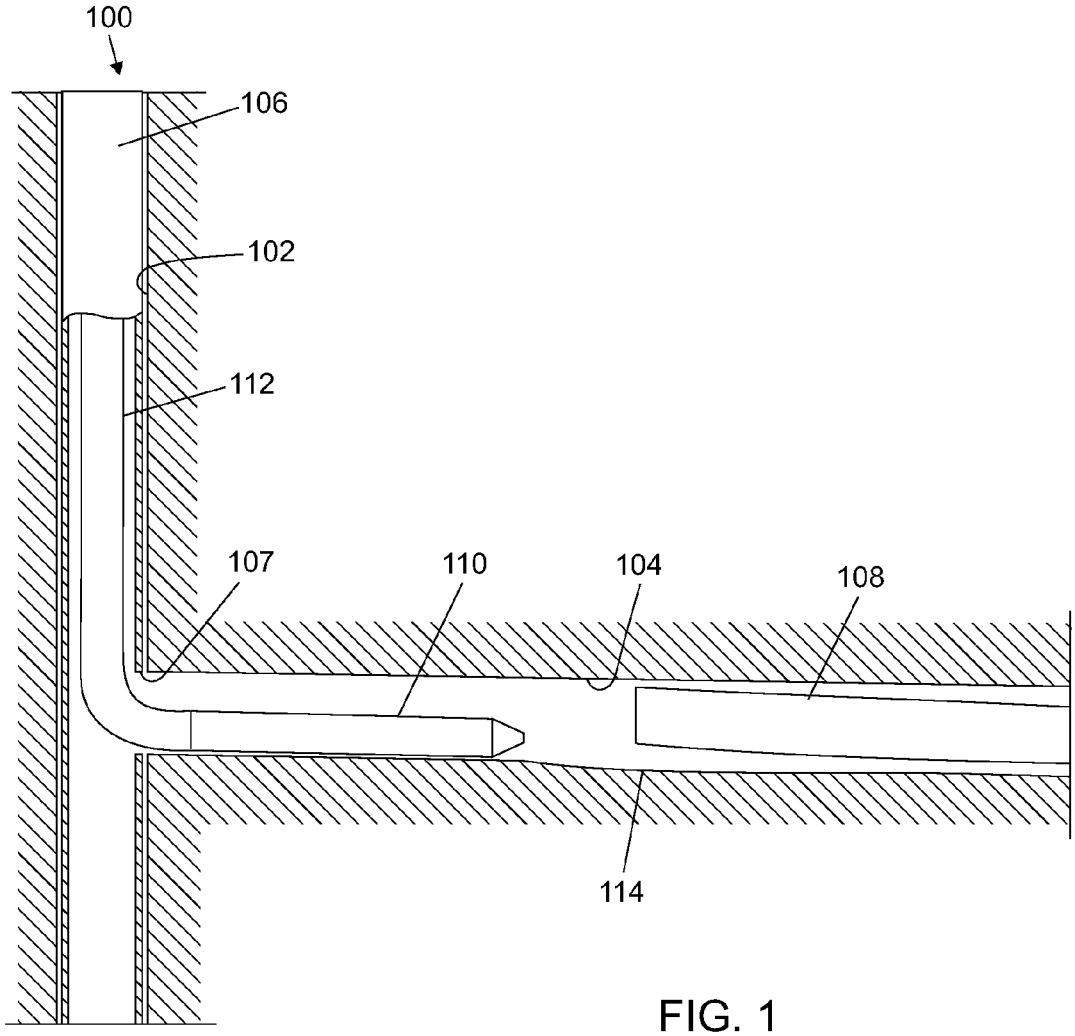
FIG. 1 is a schematic of a multilateral well in which a tubular previously installed in a lateral borehole is now eccentric with the lateral borehole.

The invention will now be described in detail with reference to a few preferred embodiments, as illustrated in the accompanying drawings. In describing the preferred embodiments, numerous specific details are set forth in order to provide a thorough understanding of the invention. However, it will be apparent to one skilled in the art that the invention may be practiced without some or all of these specific details. In other instances, well-known features and/or process steps have not been described in detail so as not to unnecessarily obscure the invention. In addition, like or identical reference numerals are used to identify common or similar elements.

FIG. 1 illustrates an example of a multilateral well 100 in which the method and apparatus of the invention may be employed. The multilateral well 100 includes a primary borehole 102 and a lateral borehole 104 branching off the primary borehole 102. The multilateral well 100 may have one or more lateral boreholes. Casing 106 may be installed in the primary borehole 102 and may include a window 107 through which the lateral borehole 104 can be accessed, in a manner well known in the art. The lateral borehole may be an open or a cased hole. A tubular 108 has been installed in the lateral borehole 104, in a manner well known in the art. For example, the tubular 108 may be a liner, such as a slotted or perforated liner, installed in the lateral borehole 104 to prevent the lateral borehole 108 from collapsing. The tubular 108 includes a bore (not shown) for receiving a downhole tool 110 at the end of a tool string 112. In the illustrated example, the tubular 108 is eccentric with the lateral borehole 104. This may be due, for example, to formation washout at 114. In accordance with the invention, a downhole tool is provided with an aligning mechanism to facilitate entry of the downhole tool into an eccentric. In general, the aligning mechanism lifts the nose of the downhole tool into alignment with the tubular, thereby facilitating entry of the downhole tool into the tubular.

Figure 2A:
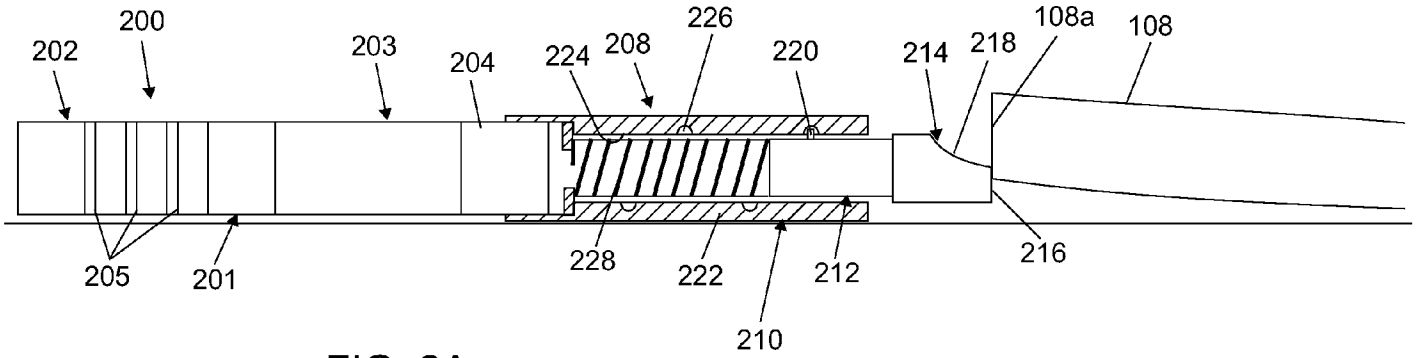
FIG. 2A is an example of a downhole tool for re-entering a tubular that is eccentric with a lateral borehole.

FIG. 2A shows an example of a downhole tool 200 having an elongated downhole tool body 202 with a rear portion 201 and nose portion 203. The rear portion 201 may or may not be formed contiguous with the nose portion 203. The downhole tool 200 is adapted to facilitate entry into a tubular in a lateral borehole when the tubular is eccentric with the lateral borehole, more specifically when the nose portion 203 is not aligned for entry into the tubular. The tool body 202 is sized for insertion into the target tubular. In one example, the nose portion 203 of the tool body 202 includes a tubular sealing element 204 for sealing engagement with a sealing surface, such as a sealing bore of a tubular. The rear portion 201 may also include additional sealing elements 205 for sealing engagement with a sealing surface. Any suitable means of conveying the downhole tool 200 into the lateral borehole, such as a string of pipes or wireline, may be coupled to the rear portion 201 of the downhole tool 200.

The downhole tool 200 includes a self-aligning mechanism 208 coupled to the nose portion 203. The self-aligning mechanism 208 includes an orientation mule shoe assembly 210. The orientation mule shoe assembly 210 includes an orientation mule shoe 212 having a generally cylindrical shape. The mule shoe 212 may also be hollow. The leading face 214 of the mule shoe 212 has a flat portion 216 and a tapered (or arcuate) portion 218. A pin 220 is provided on the body of the mule shoe 212. The mule shoe 212 is inserted in a sleeve 222. The inner wall 224 of the sleeve 222 is provided with a helical groove 226. The pin 220 on the body of the mule shoe 212 engages the helical groove 226 and can slide in the helical groove 226. A spring member 228, such as a compression spring, is disposed in the sleeve 222 and arranged to exert a biasing force against the mule shoe 212 such that the orientation mule shoe 212 extends from the sleeve 222. In this example, the sleeve 222 is coupled to a terminal end of the nose portion 203, for example, adjacent the sealing element 204, such that the orientation mule shoe sleeve 210 becomes the leading end of the downhole tool 200.

Figure 2B:
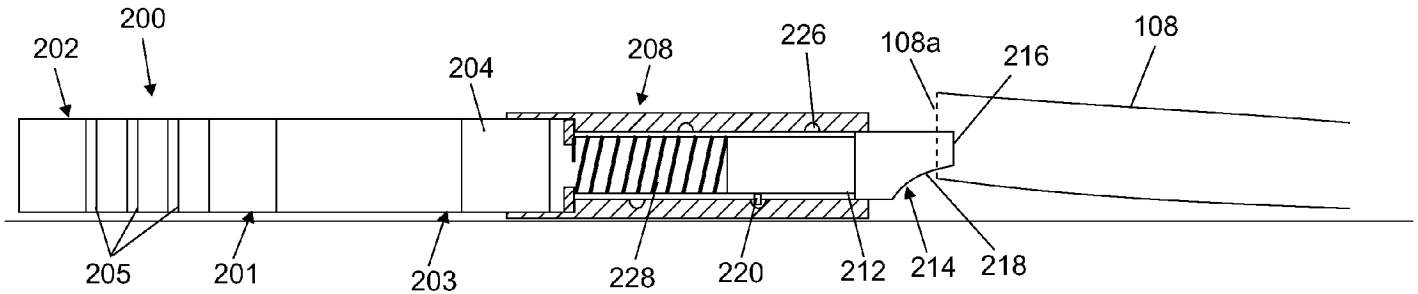
FIG. 2B shows the downhole tool of FIG. 2A aligned for entry with an eccentric tubular.

To actuate the self-aligning mechanism 208, the leading face 214 of the mule shoe 212 is brought into contact with the opposing face of the tubular 108 and an end load is applied to the downhole tool 200 at a level sufficient to overcome the biasing force of the compression spring 228. Once the spring force is overcome, the pin 220 slides in the helical groove 226, causing the mule shoe 212 to rotate along a helical path and deflect off the face of the tubular 108. With the spring force overcome, the mule shoe 212 retracts into the sleeve 222 as it rotates along the helical path. Rotation of the mule shoe 212 allows for several different positions of the mule shoe 212 relative to the face 108*a* of the tubular 108 to facilitate entry of the downhole tool 200 into the tubular 108, as shown in FIG. 2B. In an alternate embodiment, instead of compressing the spring 228 mechanically by application of an end load to the downhole tool 200, the spring 228 could be compressed hydraulically. For example, a piston (not shown) could be coupled to the mule shoe 212. When pressure differential across the piston overcomes the force of the compression spring 228, the mule shoe 212 would be allowed to rotate along a helical path. Pressure build-up to drive the piston could be achieved using a variety of methods, including, but not necessarily limited to, ball drop and choke/flow restriction. In an alternate embodiment, hydraulic activation can be used to re-orient the mule shoe 212 prior to applying an end load to the downhole tool 200. The mule shoe 212 could also be re-oriented manually by rotating the downhole tool 200. For example, the mule shoe 212 may be re-oriented so that the flat surface 216 is in contact with the opposing face 108*a* of the tubular 108, as shown in FIG. 2A, prior to applying the end load to the downhole tool 200.

In practice, the downhole tool 200 (FIG. 2A) is lowered into the primary borehole 102 (FIG. 1) using any suitable means, such as a string of pipes or wireline. The downhole tool is then passed into the lateral borehole 104 (FIG. 1). Any suitable method known in the art for locating the lateral borehole and orienting the downhole tool so that it can pass into the lateral borehole from the primary wellbore can be used. Once the downhole tool is in the lateral borehole, the orientation mule shoe 212 (FIG. 2A) can be actuated to align the nose portion of the downhole tool for entry into the tubular. To align the nose portion for entry, the orientation mule shoe is brought into contact with the tubular. The orientation mule shoe may be re-oriented if necessary so that the flat surface of the orientation mule shoe contacts the opposing face of the tubular when the orientation mule shoe is brought into contact with the tubular, as shown in FIG. 2A. The orientation mule shoe is then rotated along a helical path as described above to align the nose portion of the downhole tool with the tubular, thereby allowing the nose portion to be inserted into the tubular.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method of entering a previously-installed tubular in a lateral borehole from a primary borehole connected to the lateral borehole, comprising:

passing a downhole tool from the primary borehole into the lateral borehole;

actuating an orientation mule shoe coupled to the downhole tool to lift a nose portion of the downhole tool into alignment with the tubular in the lateral borehole; and inserting the nose portion of the downhole tool into the tubular.

2. The method of claim 1, wherein actuating the orientation mule shoe comprises bringing a leading face of the orientation mule shoe into contact with an opposing face of the tubular.

3. The method of claim 2, wherein bringing the leading face of the orientation mule shoe into contact with the opposing face of the tubular comprises bringing a flat portion of the leading face into contact with the opposing face of the tubular.

4. The method of claim 1, wherein actuating the orientation mule shoe comprises rotating the orientation mule shoe along a helical path.

5. The method of claim 4, wherein rotating the orientation mule shoe along the helical path comprises overcoming a biasing force applied against the orientation mule shoe.

6. The method of claim 5, wherein overcoming the biasing force comprises applying an end load to the downhole tool.

7. The method of claim 1, wherein passing the downhole tool from the primary borehole to the lateral borehole comprises lowering the downhole tool into the primary borehole.

8. The method of claim 7, further comprising coupling the orientation mule shoe to the nose portion of the downhole tool prior to lowering the downhole tool into the primary borehole.

9. The method of claim 1, wherein the tubular is eccentric with the lateral borehole.

10. A downhole tool for entering a previously-installed tubular in a lateral borehole of a multilateral well, comprising:

a downhole tool body sized for insertion into the tubular;

an orientation mule shoe coupled to a nose portion of the downhole tool body and rotatable to lift the nose portion into alignment with the tubular, the orientation mule shoe having a leading face including a flat portion and an arcuate portion for achieving different positions of the orientation mule shoe with respect to the tubular;

a sleeve having a substantially continuous internal helical groove, wherein the orientation mule shoe is inserted in the sleeve; and wherein the orientation mule shoe includes a pin which slidably engages the helical groove, such that rotation of the nose portion into alignment with the tubular is obtainable only by longitudinal compression of the mule shoe into the tool body.

11. The downhole tool of claim 10, wherein the orientation mule shoe includes a pin which slidably engages the helical groove.

12. The downhole tool of claim 10, wherein the sleeve is coupled to the nose portion of the downhole tool body.

13. The downhole tool of claim 10, further comprising a spring which applies a biasing force against the orientation mule shoe such that the orientation mule shoe extends from the sleeve.

* * * * *